US007757495B2

(12) United States Patent
Bessagnet et al.

(10) Patent No.: US 7,757,495 B2
(45) Date of Patent: Jul. 20, 2010

(54) TURBINE ENGINE ANNULAR COMBUSTION CHAMBER WITH ALTERNATE FIXINGS

(75) Inventors: Florian Andre Francois Bessagnet, Antony (FR); Mario Cesar De Sousa, Cesson (FR)

(73) Assignee: SNECMA, Paris (FR)

( * ) Notice: Subject to any disclaimer, the term of this patent is extended or adjusted under 35 U.S.C. 154(b) by 608 days.

(21) Appl. No.: 11/670,571

(22) Filed: Feb. 2, 2007

(65) Prior Publication Data

US 2007/0180809 A1 Aug. 9, 2007

(30) Foreign Application Priority Data

Feb. 8, 2006 (FR) ..... 06 50446

(51) Int. Cl.
*F02C 7/20* (2006.01)

(52) U.S. Cl. ..... 60/800; 60/752; 60/796

(58) Field of Classification Search ..... 60/752–760, 60/796, 798, 800, 804
See application file for complete search history.

(56) References Cited

U.S. PATENT DOCUMENTS

| | | | | |
|---|---|---|---|---|
| 3,854,285 | A * | 12/1974 | Stenger et al. | 60/756 |
| 4,433,214 | A * | 2/1984 | Jasinski | 381/398 |
| 5,181,377 | A * | 1/1993 | Napoli et al. | 60/796 |
| 5,285,635 | A * | 2/1994 | Savelli et al. | 60/804 |
| 5,331,815 | A * | 7/1994 | Reinhold et al. | 60/748 |
| 5,524,430 | A * | 6/1996 | Mazeaud et al. | 60/798 |
| 6,148,600 | A * | 11/2000 | Farmer et al. | 60/772 |
| 6,397,603 | B1 * | 6/2002 | Edmondson et al. | 60/753 |
| 6,449,952 | B1 * | 9/2002 | Emilianowicz et al. | 60/772 |
| 6,655,146 | B2 * | 12/2003 | Kutter et al. | 60/752 |
| 6,655,149 | B2 * | 12/2003 | Farmer et al. | 60/754 |
| 6,672,067 | B2 * | 1/2004 | Farmer et al. | 60/752 |
| 6,895,761 | B2 * | 5/2005 | Mitchell et al. | 60/796 |
| 6,904,757 | B2 * | 6/2005 | Mitchell et al. | 60/800 |
| 7,017,350 | B2 * | 3/2006 | De Sousa et al. | 60/796 |
| 7,062,920 | B2 * | 6/2006 | McMasters et al. | 60/800 |
| 7,093,441 | B2 * | 8/2006 | Burd et al. | 60/752 |
| 7,121,095 | B2 * | 10/2006 | McMasters et al. | 60/746 |
| 7,222,488 | B2 * | 5/2007 | Farmer et al. | 60/747 |
| 2008/0110174 | A1 * | 5/2008 | Brown et al. | 60/752 |

FOREIGN PATENT DOCUMENTS

| | | |
|---|---|---|
| EP | 1 431 665 A2 | 6/2004 |
| GB | 2 263 733 A | 8/1993 |

OTHER PUBLICATIONS

U.S. Appl. No. 11/670,510, filed Feb. 2, 2007, Bessagnet, et al.

* cited by examiner

*Primary Examiner*—William H Rodriguez
(74) *Attorney, Agent, or Firm*—Oblon, Spivak, McClelland, Maier & Neustadt, L.L.P.

(57) ABSTRACT

A turbine engine annular combustion chamber includes inner and outer longitudinal walls connected upstream by a transverse chamber bottom and including a single-piece cowling covering the chamber bottom. Each of the longitudinal walls is inserted between corresponding flanges of the chamber bottom and of the cowling. The longitudinal walls, the chamber bottom and the cowling are assembled together by a plurality of first fixings between the longitudinal walls and the chamber bottom alternating with a plurality of second fixings distinct from the first fixings between the longitudinal walls and the cowling.

19 Claims, 3 Drawing Sheets

TURBINE ENGINE ANNULAR COMBUSTION CHAMBER WITH ALTERNATE FIXINGS

BACKGROUND OF THE INVENTION

The present invention relates to the general field of annular combustion chambers for turbine engines equipped with a single-piece protective cowling for the fuel injection systems.

A turbine engine annular combustion chamber is generally made up of two longitudinal walls generated by revolution (an outer wall and an inner wall) which are connected upstream by a transverse wall forming the chamber bottom.

The present invention relates more particularly to combustion chambers that also comprise a single-piece cowling mounted upstream of the chamber bottom. The cowling is used in particular to protect the fuel injection systems which are mounted on the chamber bottom.

Assembling these different elements of the combustion chamber is carried out by means of bolt connections mounted at the inner and outer walls. More precisely, the chamber bottom and the cowling each comprise an inner flange and an outer flange on which respectively the inner wall and the outer wall of the combustion chamber are fixed by bolt connections, these longitudinal walls being inserted between the cowling and the chamber bottom. Thus, the same bolt connection passes through all the following: one of the longitudinal walls, the chamber bottom and the cowling of the combustion chamber.

In practice, this type of combustion chamber architecture poses many problems. In particular, the different elements of the combustion chamber have large manufacturing tolerances, which leads to stacking up of the tolerances resulting in poor closing up between these elements when the combustion chamber is being assembled, which creates a loss as regards the clamping transiting between the flanges. This is because the part of the clamping which is used for deforming the chamber is subtracted from the force of reactions between its components. When this reaction force decreases, the force necessary for making the parts slide among themselves is therefore less. An additional clamping torque is therefore necessary for taking up the play due to the manufacturing tolerances of the components and thus keeping the correct clamping force for passage of the sliding forces transiting in the connection. Therefore, during operation, the vibrations caused by the combustion of gases inside the combustion chamber lead to the formation of cracks in the region of the bolt connections on the cowling and/or the chamber bottom. Such cracks are particularly prejudicial to the service life of the combustion chamber.

OBJECT AND SUMMARY OF THE INVENTION

The main aim of the present invention is therefore to overcome such drawbacks by proposing an annular combustion chamber architecture that is easy to assemble and has sufficient flexibility to avoid the formation of cracks whilst retaining a necessary clamping effectiveness.

To that end, a turbine engine annular combustion chamber is provided, made up of inner and outer longitudinal walls connected upstream by a transverse chamber bottom and comprising a single-piece cowling covering said chamber bottom, the longitudinal walls each being inserted between corresponding flanges of the chamber bottom and of the cowling, characterised in that the longitudinal walls, the chamber bottom and the cowling are assembled together by means of a plurality of first fixings between the longitudinal walls and the chamber bottom alternating with a plurality of second fixings distinct from the first fixings between the longitudinal walls and the cowling.

Alternating the fixing of the longitudinal walls on the chamber bottom and the cowling of the combustion chamber makes it possible to reduce the stacking up of manufacturing tolerances of these elements by a third. This results in less rigidity of the assembly and thus better closing up between these elements during assembling of the chamber and reduction of the risks of formation of cracks.

Furthermore, a solution consisting simply of reducing the manufacturing tolerances of the combustion chamber elements would prove much more expensive to achieve than use of the present invention.

According to an advantageous provision of the invention, there are provided as many first fixings between the longitudinal walls and the chamber bottom as second fixings between the longitudinal walls and the cowling.

According to another advantageous provision of the invention, the first fixings between the inner longitudinal wall and the chamber bottom are situated opposite the second fixings between the outer longitudinal wall and the cowling, and the second fixings between the inner longitudinal wall and the cowling are situated opposite the first fixings between the outer longitudinal wall and the chamber bottom. This provision makes it possible to avoid any cyclic dissymmetry of the azimuthal flexibilities and rigidities and therefore prevent any damaging effect that may be generated by the vibratory stresses of the combustion chamber during its operation.

The flanges of the chamber bottom preferably comprise notches made in the region of the second fixings between the longitudinal walls and the cowling. Similarly, the flanges of the cowling advantageously comprise notches made in the region of the first fixings between the longitudinal walls and the chamber bottom. The presence of notches thus makes it possible to facilitate the assembling of the combustion chamber.

Another object of the present invention is a turbine engine having an annular combustion chamber as defined previously.

BRIEF DESCRIPTION OF THE DRAWINGS

Other characteristics and advantages of the present invention will emerge from the description given below, with reference to the accompanying drawings which illustrate an example embodiment thereof lacking any limiting nature. In the figures.

DETAILED DESCRIPTION OF ONE EMBODIMENT

Figure 1:
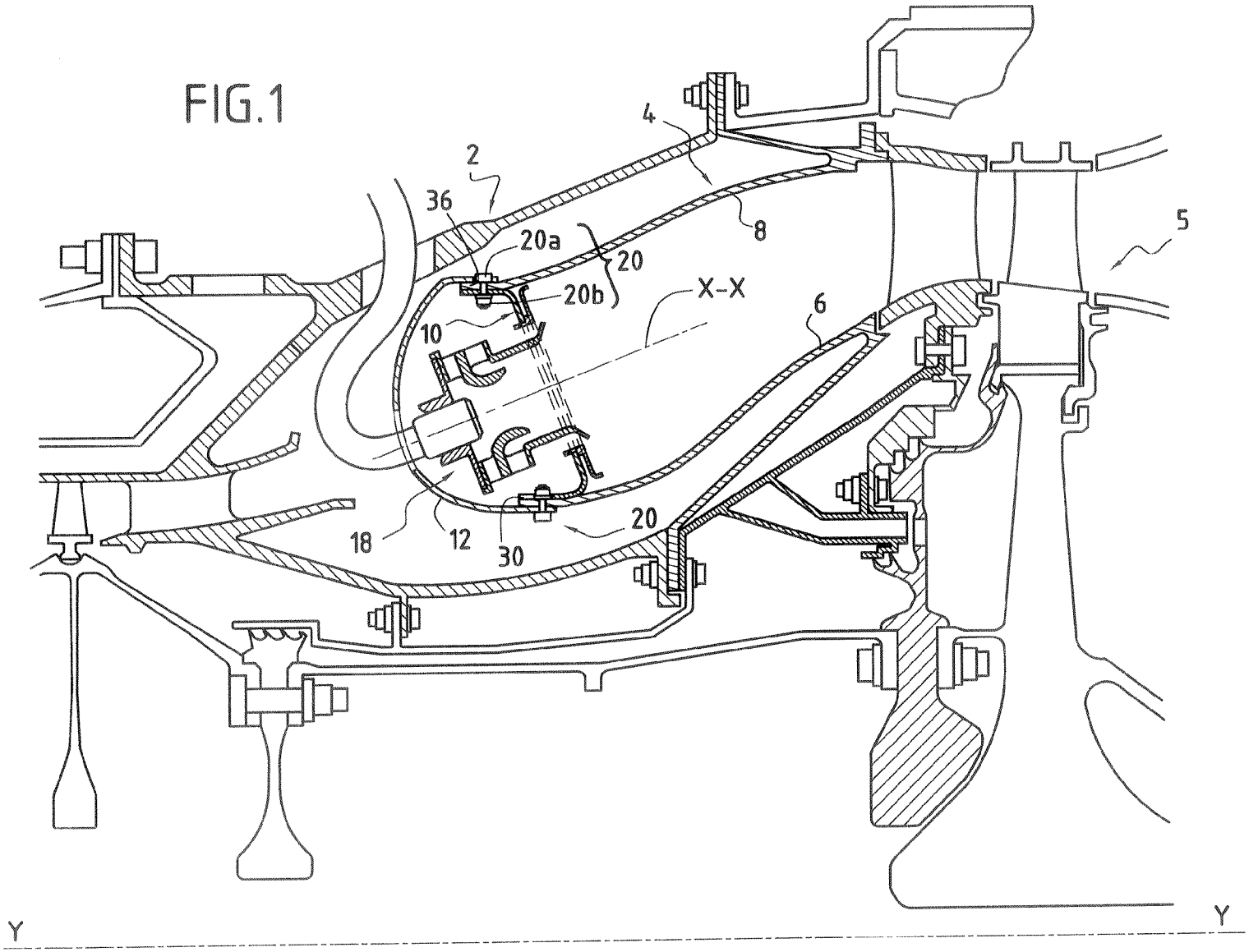
FIG. 1 is a view in longitudinal section of a turbine engine combustion chamber according to the invention.

FIGS. 1 to 4 illustrate a combustion chamber for a turbine engine according to the invention.

Such a turbine engine, for example an aeronautical one, comprises in particular a compression section (not depicted) wherein air is compressed before being injected into a chamber housing 2, and then into a combustion chamber 4 mounted inside the latter.

The compressed air is introduced into the combustion chamber and mixed with fuel before being burned therein. The gases resulting from this combustion are then directed to a high-pressure turbine 5 disposed at the output of the combustion chamber.

The combustion chamber 4 is of annular type. It is made up of an inner annular wall 6 and an outer annular wall 8 which are joined upstream (with respect to the direction of flow of the combustion gases in the combustion chamber) by a transverse annular wall 10 forming the chamber bottom.

The combustion chamber also comprises an annular single-piece cowling 12 (that is to say a cowling made in one and the same piece) covering the chamber bottom 10.

The longitudinal walls 6, 8 of the combustion chamber extend along a longitudinal axis X-X which can be slightly inclined with respect to the longitudinal axis Y-Y of the turbine engine as depicted in FIG. 1.

Of course, the present invention also applies to combustion chambers whereof the longitudinal walls are not inclined with respect to the longitudinal axis of the turbine engine.

Furthermore, the chamber bottom 10 and the cowling 12 of the combustion chamber are each provided with a plurality of openings, respectively 14 and 16, for the passage of fuel injection systems 18.

The main components of the combustion chamber (namely the longitudinal walls 6, 8, the chamber bottom 10 and the cowling 12) are assembled together by means of a plurality of fixing systems 20 distributed regularly over the entire circumference of the combustion chamber and each made up of a bolt 20*a* and a clamping nut 20*b*.

Figure 2:
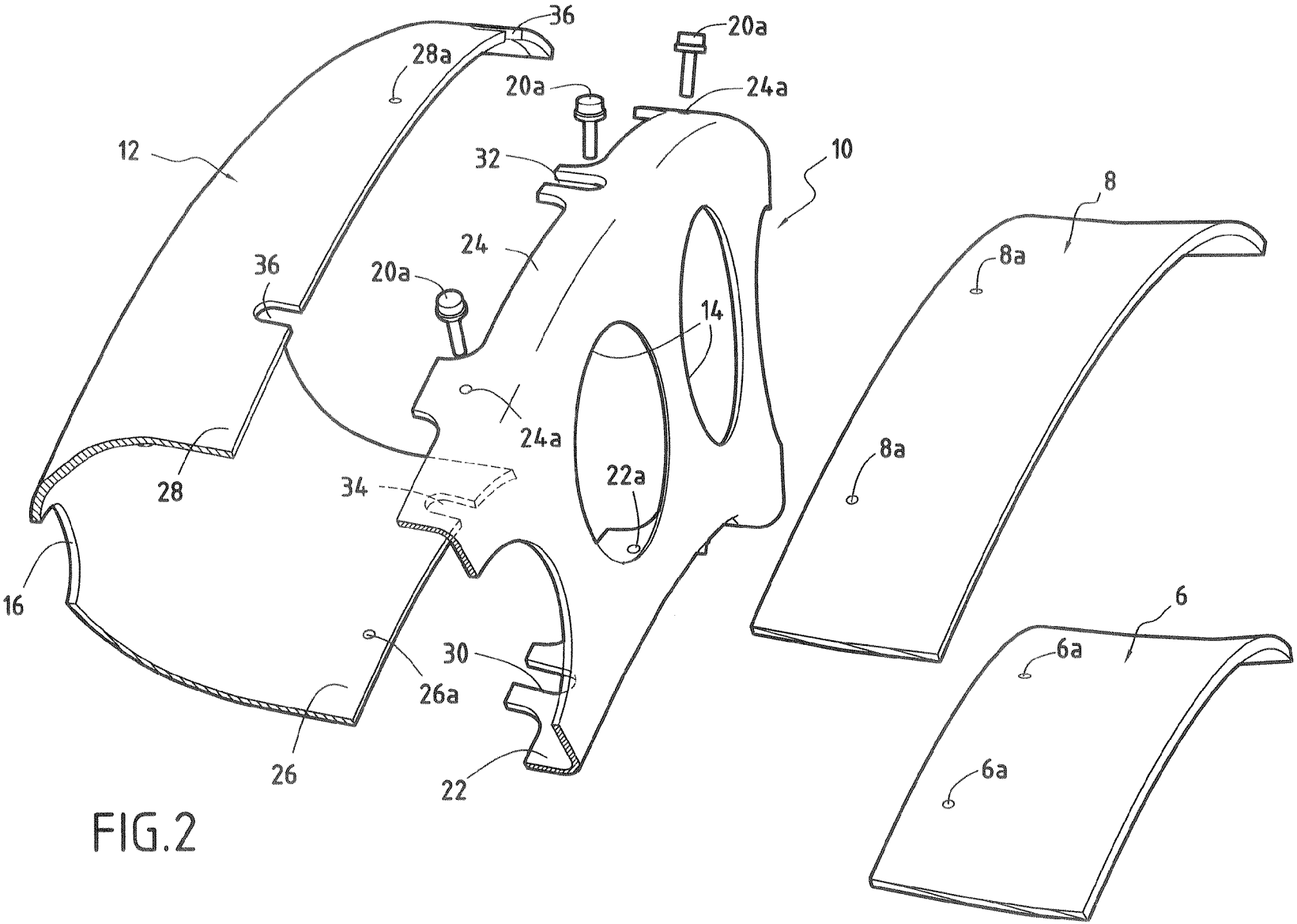
FIG. 2 is a partial view in perspective of the combustion chamber of FIG. 1 before its assembly.
Figure 3:
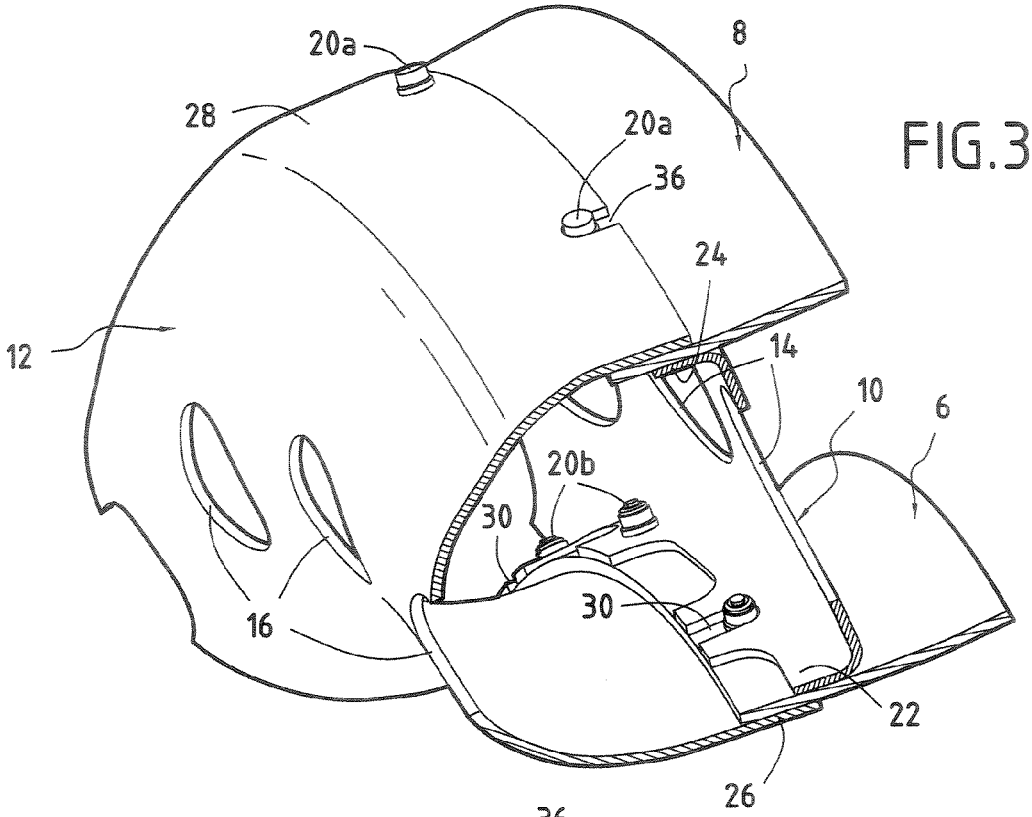
FIG. 3 is a partial view in perspective of the combustion chamber of FIG. 2 after its assembly.

More precisely, as depicted in FIGS. 2 and 3, the chamber bottom 10 comprises an inner flange 22 and an outer flange 24 extending longitudinally towards upstream and each provided with holes, respectively 22*a* and 24*a*, for the passage of fixing bolts 20*a*.

Similarly, the single-piece cowling 12 comprises an inner flange 26 and an outer flange 28 which extend longitudinally towards downstream and which are each provided with holes, respectively 26*a* and 28*a*, for passage of the fixing bolts 20*a*.

As regards the longitudinal walls 6, 8 of the combustion chamber, these also have a plurality of holes, respectively 6*a* and 8*a*, made in them at their upstream end for passage of the fixing bolts 20*a*.

Assembling of these components of the combustion chamber is carried out by inserting the longitudinal walls 6, 8 between the respective flanges of the chamber bottom 10 and of the cowling 12 as depicted in FIGS. 1 and 3. The assembly is then held by the fixing bolts 20*a* on which the nuts 20*b* are tightened.

According to the invention, the longitudinal walls 6, 8, the chamber bottom 10 and the cowling 12 are assembled alternately in pairs by the fixing systems 20.

Figure 4:
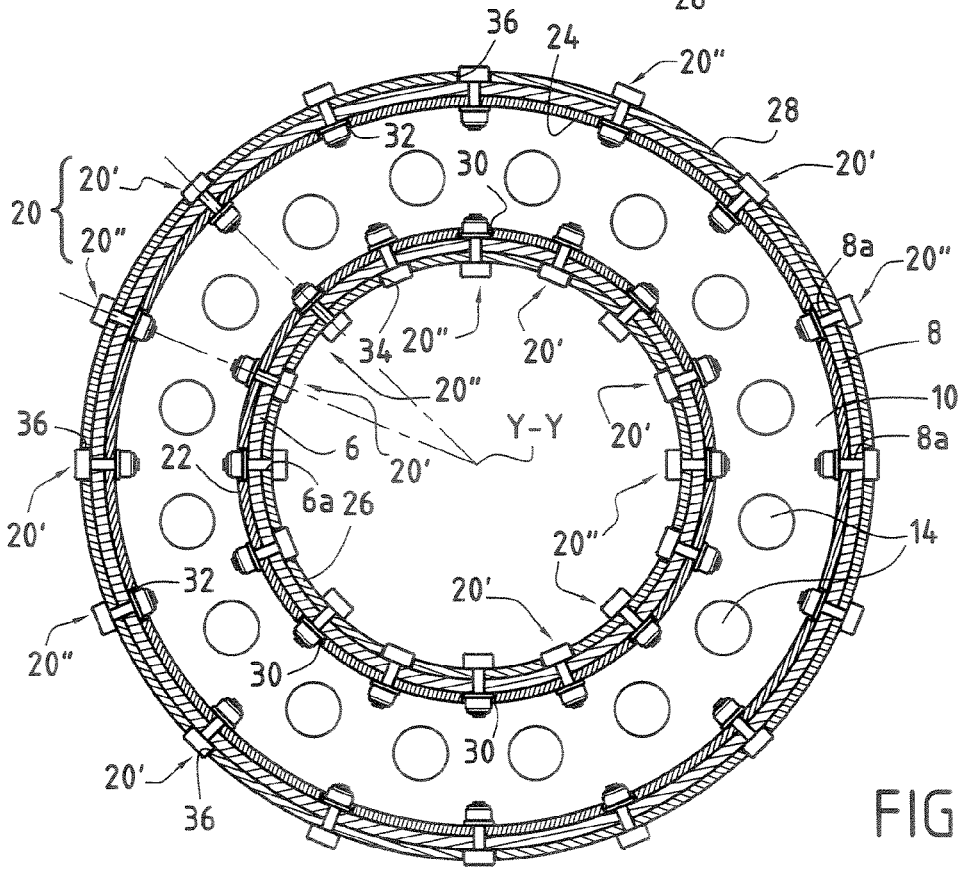
FIG. 4 is a schematic view of the combustion chamber of FIG. 1 showing the location of the different fixings between the elements comprising it.

In other words, as depicted by FIG. 4, the fixing systems 20 for assembling these elements are divided into two groups: a first group of fixing systems 20' clamping only the longitudinal walls 6, 8 and the corresponding flanges 22, 24 of the chamber bottom 10, and a second group of fixing systems 20" clamping only the longitudinal walls 6, 8 and the corresponding flanges 26, 28 of the cowling 12, the fixing systems 20" of the second group being distinct from the fixing systems 20' of the first group and arranged alternately with them.

Thus, each of the fixing systems 20', 20" belonging to these groups passes through only two of the elements making up the combustion chamber, namely either one of the longitudinal walls 6, 8 and the corresponding flange 22, 24 of the chamber bottom 10, or one of the longitudinal walls 6, 8 and the corresponding flange 26, 28 of the cowling 12.

According to an advantageous characteristic of the invention illustrated in FIG. 4, there are provided as many fixing systems 20' belonging to the first group (that is to say fixing systems between the longitudinal walls 6, 8 and the chamber bottom 10) as fixing systems 20" belonging to the second group (that is to say fixing systems between the longitudinal walls 6, 8 and the cowling 12). For example, eight fixing systems for each group can be provided.

Furthermore, it may be noted that, in order to obtain an alternation of fixing systems 20', 20" belonging to each group which is uniform over the entire circumference of the combustion chamber, it is necessary to have an even number of fixing systems.

According to another advantageous characteristic of the invention also illustrated in FIG. 4, the fixing systems 20' between the inner longitudinal wall 6 and the chamber bottom 10 are situated opposite the fixing systems 20" between the outer longitudinal wall 8 and the cowling 12, and the fixing systems 20" between the inner longitudinal wall 6 and the cowling 12 are situated opposite the fixing systems 20' between the outer longitudinal wall 8 and the chamber bottom 10.

The expression "situated opposite" means that the fixing systems are aligned in the same radial direction defined with respect to the longitudinal axis Y-Y of the turbine engine as illustrated in FIG. 4.

According to yet another advantageous characteristic of the invention, the inner flange 22 and the outer flange 24 of the chamber bottom 10 comprise notches, respectively 30 and 32, which are made in the region of the fixing systems 20" between the longitudinal walls 6, 8 and the cowling 12.

Similarly, the inner flange 26 and the outer flange 28 of the cowling 12 preferably comprise notches, respectively 34 and 36, which are made in the region of the fixing systems 20' between the longitudinal walls 6, 8 and the chamber bottom 10.

The presence of such notches 30 to 36 on the flanges of the chamber bottom and of the cowling has the advantage of facilitating the assembling of these two elements of the combustion chamber. Of course, such notches have sufficient dimensions to allow the passage of the bolts 20*a* and nuts 20*b* of the fixing systems.

The invention claimed is:

1. A turbine engine annular combustion chamber made up of inner and outer longitudinal walls connected upstream by a transverse chamber bottom and comprising a single-piece cowling covering said chamber bottom, the longitudinal walls each being inserted between corresponding flanges of the chamber bottom and of the cowling, wherein the longitudinal walls, the chamber bottom and the cowling are assembled together by a plurality of first fixings between the longitudinal walls and the chamber bottom alternating with a plurality of second fixings distinct from the first fixings between the longitudinal walls and the cowling, and wherein said first fixings clamp only said longitudinal walls to said chamber bottom, and said second fixings clamp only said longitudinal walls to said cowling.

2. A chamber according to claim 1, comprising as many first fixings between the longitudinal walls and the chamber bottom as second fixings between the longitudinal walls and the cowling.

3. A chamber according to claim 2, wherein the first fixings between the inner longitudinal wall and the chamber bottom are situated opposite the second fixings between the outer longitudinal wall and the cowling, and the second fixings between the inner longitudinal wall and the cowling are situated opposite the first fixings between the outer longitudinal wall and the chamber bottom.

4. A chamber according to claim 1, wherein the flanges of the chamber bottom comprise notches made in the region of the second fixings between the longitudinal walls and the cowling.

5. A chamber according to claim 4, wherein the flanges of the cowling comprise notches made in the region of the first fixings between the longitudinal walls and the chamber bottom.

6. A chamber according to claim 5, wherein each of said first and second fixings includes a bolt and a nut.

7. A chamber according to claim 6, wherein each of the notches on said chamber bottom and on said cowling has sufficient dimensions to allow passage of the bolt and nut of said first and second fixings.

8. A turbine engine comprising an annular combustion chamber according to claim 1.

9. A chamber according to claim 1, wherein each of said first fixings is adjacent and between two of said second fixings and each of said second fixings is adjacent and between two of said first fixings.

10. A turbine engine annular combustion chamber made up of inner and outer longitudinal walls connected upstream by a transverse chamber bottom and comprising a single-piece cowling covering said chamber bottom, the longitudinal walls each being inserted between corresponding flanges of the chamber bottom and of the cowling, wherein the longitudinal walls, the chamber bottom and the cowling are assembled together by a plurality of first fixings between the longitudinal walls and the chamber bottom alternating with a plurality of second fixings distinct from the first fixings between the longitudinal walls and the cowling, wherein the first fixings between the inner longitudinal wall and the chamber bottom are situated opposite the second fixings between the outer longitudinal wall and the cowling, and the second fixings between the inner longitudinal wall and the cowling are situated opposite the first fixings between the outer longitudinal wall and the chamber bottom.

11. A turbine engine annular combustion chamber made up of inner and outer longitudinal walls connected upstream by a transverse chamber bottom and comprising a single-piece cowling covering said chamber bottom, the longitudinal walls each being inserted between corresponding flanges of the chamber bottom and of the cowling, wherein the longitudinal walls, the chamber bottom and the cowling are assembled together by a plurality of first fixings between the longitudinal walls and the chamber bottom alternating with a plurality of second fixings distinct from the first fixings between the longitudinal walls and the cowling, and wherein each of said first fixings passes through only said longitudinal walls and said chamber bottom, and wherein each of said second fixings passes through only said longitudinal walls and said cowling.

12. A chamber according to claim 11, comprising as many first fixings between the longitudinal walls and the chamber bottom as second fixings between the longitudinal walls and the cowling.

13. A chamber according to claim 12, wherein the first fixings between the inner longitudinal wall and the chamber bottom are situated opposite the second fixings between the outer longitudinal wall and the cowling, and the second fixings between the inner longitudinal wall and the cowling are situated opposite the first fixings between the outer longitudinal wall and the chamber bottom.

14. A chamber according to claim 11, wherein the flanges of the chamber bottom comprise notches made in the region of the second fixings between the longitudinal walls and the cowling.

15. A chamber according to claim 14, wherein the flanges of the cowling comprise notches made in the region of the first fixings between the longitudinal walls and the chamber bottom.

16. A chamber according to claim 15, wherein each of said first and second fixings includes a bolt and a nut.

17. A chamber according to claim 16, wherein each of the notches on said chamber bottom and on said cowling has sufficient dimensions to allow passage of the bolt and nut of said first and second fixings.

18. A turbine engine comprising an annular combustion chamber according to claim 11.

19. A chamber according to claim 11, wherein each of said first fixings is adjacent and between two of said second fixings and each of said second fixings is adjacent and between two of said first fixings.

* * * * *